US006275156B1

(12) United States Patent
Rasband

(10) Patent No.: US 6,275,156 B1
(45) Date of Patent: Aug. 14, 2001

(54) EAS READY PAPERBOARD

(75) Inventor: Paul Brent Rasband, Frederick, MD (US)

(73) Assignee: Westvaco Corporation, Stamford, CT (US)

( * ) Notice: Subject to any disclaimer, the term of this patent is extended or adjusted under 35 U.S.C. 154(b) by 0 days.

(21) Appl. No.: 09/499,117

(22) Filed: Feb. 7, 2000

(51) Int. Cl.[7] ..... G08B 13/14

(52) U.S. Cl. ..... 340/572.1; 340/571; 340/572; 340/572.8; 428/40

(58) Field of Search ..... 340/572, 572.8, 340/571; 428/40

(56) References Cited

U.S. PATENT DOCUMENTS

| | | | | |
|---|---|---|---|---|
| 3,810,147 | | 5/1974 | Lichtblau | 340/280 |
| 4,063,229 | * | 12/1977 | Welsh et al. | 340/280 |
| 4,583,009 | | 4/1986 | Reilly et al. | 343/895 |
| 4,710,754 | * | 12/1987 | Montean | 340/572 |
| 5,019,436 | * | 5/1991 | Schramer et al. | 428/40 |
| 5,353,011 | * | 10/1994 | Wheeler et al. | 340/572 |
| 5,405,702 | * | 4/1995 | Piotrowski et al. | 428/458 |
| 5,580,664 | * | 12/1996 | Tsai | 428/457 |
| 5,587,703 | * | 12/1996 | Dumont | 340/572 |
| 5,714,935 | * | 2/1998 | Ryan, Jr. | 340/572 |
| 5,781,110 | | 7/1998 | Habeger et al. | 340/572 |
| 5,790,029 | * | 8/1998 | Curnutte et al. | 340/572 |
| 5,844,485 | * | 12/1998 | Ryan, Jr. | 340/572 |
| 5,982,284 | * | 11/1999 | Baldwin et al. | 340/572.8 |
| 5,984,388 | * | 11/1999 | Bacon | 292/307 R |

* cited by examiner

*Primary Examiner*—Benjamin C. Lee
*Assistant Examiner*—Phung T Nguyen

(57) ABSTRACT

The present invention relates to a method for combining RF-EAS circuits with paperboard for producing disposable RF-EAS security tags, or to a method for manufacturing paperboard packaging, such as trays, lids, cartons containers or combinations with an integral RF-EAS security tag.

6 Claims, 1 Drawing Sheet

EAS READY PAPERBOARD

BACKGROUND OF INVENTION

The present invention relates generally to a method for combining an RF-EAS circuit with paperboard. More particularly, the invention relates to such a method whereby the RF-EAS circuits are sandwiched between two webs of paperboard on a printing press or the like. The combined structure may then be converted into disposable RF-EAS security tags or into packaging blanks (e.g., trays, lids, cartons, containers, etc.), at the same time that product ID's and sales graphics are printed on the paperboard.

RF-EAS (Electronic Article Surveillance) tags are passive circuits with a resonance frequency tuned to the frequency of tag detectors located at the entrances and exits of retail establishments. When an active tag passes through a detector, an alarm sounds, alerting store employees to the potential theft of the tagged merchandise. State of the art RF-EAS tags are generally produced by a number of steps which include stamping, masking, photochemical treatments, chemical etching and printing. However, the tags currently available are too expensive to be economically used on items retailing for about $5.00 or less. The use of currently available tags entails not only the cost of the tag itself, but the cost of application of the tag to the product or its package, either on a packaging line, in a warehouse, or in the retailer's stockroom.

Such tags may be buried beneath various layers of material without reducing their effectiveness. Obviously, the more deeply the tag is embedded in the merchandise, the more difficult it is to circumvent. For example, an EAS tag in the form of a pressure sensitive label that is applied to a package exterior is easily removed. Such a label located beneath shrink wrap is visible, and can still be removed, but the removal process is more difficult. Tags hidden beneath the product ID label are generally not visible, and thus are more difficult to detect and remove. Meanwhile, a security tag located inside a package is hidden from view, and therefore less likely to be removed, but such tags are difficult to deactivate for a legitimate sale. Thus there remains a need in the art to provide a reliable EAS tag that would be normally hidden from view in use to protect against detection and removal, but easily deactivated when needed for a legitimate sale. The present invention fulfils that need by combining paperboard and an EAS circuit in such a manner that the EAS circuit is completely hidden in use but readily deactivated when necessary.

SUMMARY OF INVENTION

The present invention relates generally to the high speed, mass production of EAS security tags, or to packaging which includes an integral security tag. The present invention is carried out by sandwiching RF-EAS circuits between two layers of paper or paperboard at the same time that product ID's and sales graphics are printed on the paper or paperboard. The specific method or methods for preparing the EAS circuits for use in the present invention are not a part of the present invention. For example, the circuits could be fabricated separately and provided with a pressure sensitive adhesive backing for application to the paper or paperboard in a typical windowing apparatus used to apply windows to envelopes. Alternatively, the EAS circuits could be applied directly to one layer of the paperboard sandwich in the manner disclosed in applicant's pending U.S. patent application Ser. No. 09/362,614, assigned to the present assignee herein. Other examples of such circuits are disclosed for example in U.S. Pat. Nos. 3,810,147; 4,583,099; and 5,781,110.

The advantages of the present invention include economics of cost in producing RF-EAS tags that have hidden circuits, or packaging material with integral RF-EAS tags that are undetectable.

DESCRIPTION OF DRAWING

The FIGURE of drawing illustrates schematically how the EAS circuit is sandwiched between two layers of paper or paperboard.

DETAILED DESCRIPTION

Figure 1:
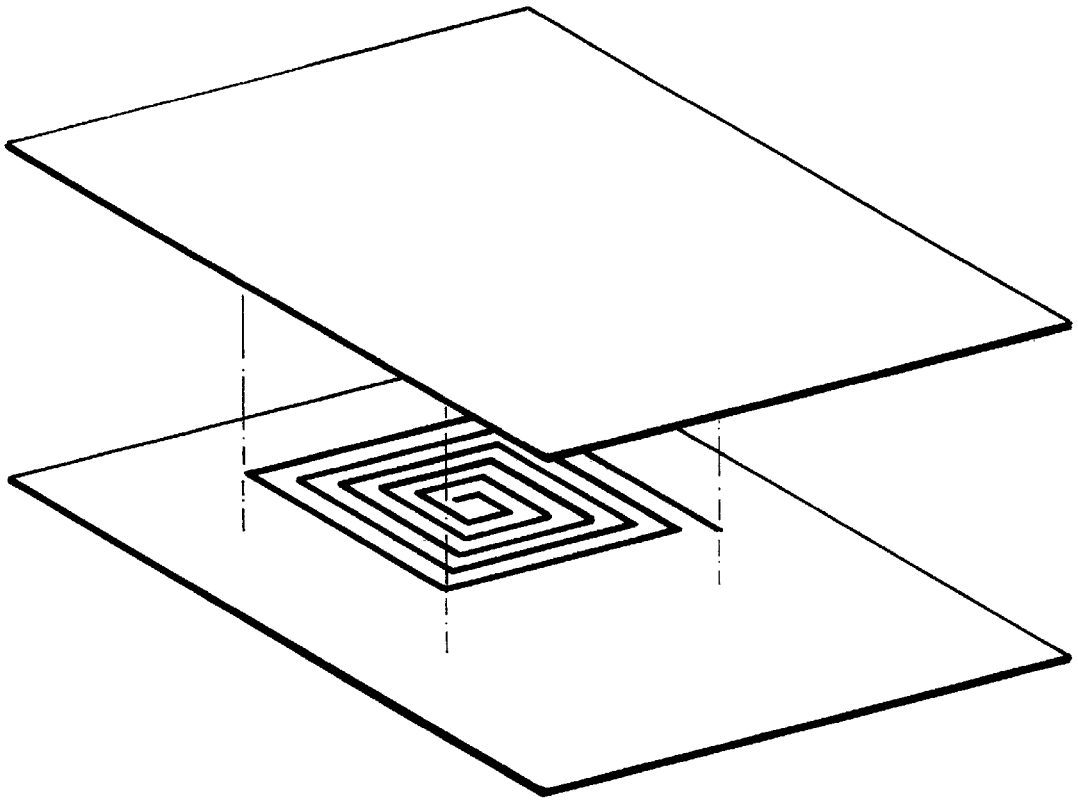

As shown in FIG. 1 of drawing, the EAS ready paperboard product of the present invention comprises an EAS circuit sandwiched between two layers of paperboard. The EAS circuit may be directly stamped/printed on a first sheet of paperboard or adhered thereto as a separate element using pressure sensitive adhesive or the like. Subsequently, the sheet carrying the EAS circuits is laminated or bonded to a second sheet of paper or paperboard so as to sandwich the EAS circuits therebetween using conventional laminating processes known in the art. In the same or a separate operation, the laminated product may be printed with suitable graphics and converted using conventional cutting and folding devices into separate security tags each including an embedded EAS circuit, or into packaging blanks each including an integral EAS circuit.

The EAS ready paperboard product can be used for any bleached board or kraft board application desired which requires security protection. Examples include food, cigarette and spirits, hardware and automotive, clothing and pharmaceutical packaging and ID's applied to retail items. In its final stage, the converted packaging or security tag/label has the distinction of including the EAS circuit completely hidden, yet susceptible of being deactivated as required.

Accordingly, while only one method has been fully described herein for making the product of the present invention, it will be obvious to those skilled in the art that other methods and techniques may be used to carry out the invention substantially as encompassed by the appended claims.

What is claimed is:

1. A method for producing EAS security tags or packaging blanks with integral security circuits in which such circuits are completely hidden, comprising:

a) selecting a first sheet of paperboard material having an outer surface and an inner surface;

b) printing graphics substantially over the outer surface of said first sheet;

c) applying to the inner surface of said first sheet a plurality of EAS circuits comprising inductor/capacitor elements tuned to resonate at a specified frequency when exposed to electromagnetic energy;

d) bonding a second sheet of paperboard material to the first sheet so as to sandwich the EAS circuits therebetween; and e) converting the bonded sheets of step (d) into separate EAS tags or packaging blanks.

2. The method of claim 1 wherein the sheets of paperboard comprise bleached board or kraft board.

3. An EAS security tag comprising an EAS circuit sandwiched between two bonded sheets of paperboard material such that the EAS circuit is completely hidden.

4. The security tag of claim 3 wherein the sheets of paperboard material bleached board or kraft board.

5. A security tag formed according to the method of claim 1.

6. A packaging blank formed according to the method of claim 1.

* * * * *